US010874996B2

(12) United States Patent
Tsuchiya et al.

(10) Patent No.: US 10,874,996 B2
(45) Date of Patent: Dec. 29, 2020

(54) NANOBUBBLE GENERATING NOZZLE AND NANOBUBBLE GENERATOR

(71) Applicant: Aqua Solution Co., Ltd., Nagano (JP)

(72) Inventors: Yukihiro Tsuchiya, Nagano (JP); Tomohiro Ota, Nagano (JP); Takahumi Goto, Nagano (JP)

(73) Assignee: AQUA SOLUTION CO., LTD., Nagano (JP)

( * ) Notice: Subject to any disclaimer, the term of this patent is extended or adjusted under 35 U.S.C. 154(b) by 0 days.

(21) Appl. No.: 16/239,311

(22) Filed: Jan. 3, 2019

(65) Prior Publication Data

US 2019/0134574 A1 May 9, 2019

Related U.S. Application Data

(63) Continuation-in-part of application No. PCT/JP2016/084129, filed on Nov. 17, 2016.

(30) Foreign Application Priority Data

Jul. 28, 2016 (JP) ..... 2016-148510

(51) Int. Cl.
*B01F 3/04* (2006.01)
*B05B 7/04* (2006.01)
(Continued)

(52) U.S. Cl.
CPC ..... *B01F 3/04503* (2013.01); *B01F 3/0446* (2013.01); *B01F 5/0206* (2013.01);
(Continued)

(58) Field of Classification Search
CPC .. B01F 3/04503; B01F 3/0446; B01F 5/0206; B01F 5/0281; B01F 5/0644;
(Continued)

(56) References Cited

U.S. PATENT DOCUMENTS 1,964,942 A * 7/1934 Hallgarth ..... B01F 5/0644 261/76
3,376,023 A * 4/1968 Lage ..... B01F 5/0682 366/167.1
(Continued)

FOREIGN PATENT DOCUMENTS

JP 2008-246486 A 10/2008
JP 2011-056511 A 3/2011
(Continued)

OTHER PUBLICATIONS

International Search Report issued in corresponding International Patent Application No. PCT/JP2016/084129, dated Feb. 7, 2017, with English Translation.
(Continued)

*Primary Examiner* — Charles S Bushey
(74) *Attorney, Agent, or Firm* — McDermott Will & Emery LLP

(57) ABSTRACT

To provide a nanobubble generating nozzle that is compact and capable of generating nanobubbles with high efficiency. The problem is solved by a nanobubble generating nozzle and a nanobubble generator including this nanobubble generating nozzle. The nanobubble generating nozzle includes an introduction part for introducing a mixed fluid of a liquid and a gas into an interior thereof, a jetting part for feeding out the mixed fluid containing nanobubbles of the gas, and a nanobubble generating structure part for generating nanobubbles of the gas, between the introduction part and the jetting part. The nanobubble generating structure part includes a plurality of flow paths having different cross-sectional areas through which the mixed fluid of the liquid and the gas is passed, in an axial direction of the nanobubble generating nozzle.

8 Claims, 6 Drawing Sheets

(51) Int. Cl.

| | |
|---|---|
| ***B01F 5/06*** | (2006.01) |
| ***B01F 5/02*** | (2006.01) |
| ***B01F 5/08*** | (2006.01) |
| ***B01F 5/10*** | (2006.01) |
| *B01F 5/00* | (2006.01) |

(52) U.S. Cl.
CPC ..... *B01F 5/0281* (2013.01); *B01F 5/0644* (2013.01); *B01F 5/0645* (2013.01); *B01F 5/0688* (2013.01); *B01F 5/08* (2013.01); *B01F 5/102* (2013.01); *B01F 5/106* (2013.01); *B01F 5/108* (2013.01); *B05B 7/04* (2013.01); *B01F 2005/0022* (2013.01); *B01F 2005/0025* (2013.01); *B01F 2215/0431* (2013.01)

(58) Field of Classification Search
CPC ..... B01F 5/0645; B01F 5/0688; B01F 5/08; B01F 5/102; B01F 5/106; B01F 5/108; B01F 2005/0022; B01F 2005/0025; B01F 2215/0431; B05B 7/04
USPC ..... 261/28, 29, 36.1, 76
See application file for complete search history.

(56) References Cited

U.S. PATENT DOCUMENTS

| | | | | |
|---|---|---|---|---|
| 5,160,458 | A * | 11/1992 | Yap | B01F 5/0451 261/76 |
| 5,302,325 | A * | 4/1994 | Cheng | B01F 5/0416 261/76 |
| 7,338,551 | B2 * | 3/2008 | Kozyuk | B01F 3/0446 261/123 |
| 7,762,715 | B2 * | 7/2010 | Gordon | B01F 5/0604 366/176.1 |
| 7,913,984 | B2 * | 3/2011 | Noguchi | B01F 3/0446 261/29 |
| 8,042,989 | B2 * | 10/2011 | Gordon | B01F 13/1013 366/176.1 |
| 8,871,090 | B2 * | 10/2014 | Livshits | B01F 3/0865 210/221.2 |
| 9,126,176 | B2 * | 9/2015 | Kravtsov | C02F 1/34 |
| 9,808,810 | B2 * | 11/2017 | Park | B01F 3/04241 |
| 2004/0251566 | A1 * | 12/2004 | Kozyuk | B01F 3/0446 261/76 |
| 2009/0273103 | A1 | 11/2009 | Watanabe | |
| 2009/0293920 | A1 | 12/2009 | Watanabe | |
| 2010/0010422 | A1 | 1/2010 | Watanabe | |
| 2010/0301498 | A1 | 12/2010 | Matsumura et al. | |
| 2013/0193081 | A1 * | 8/2013 | Vasiliu | B01F 3/04503 210/760 |
| 2017/0028364 | A1 | 2/2017 | Matsunaga et al. | |

FOREIGN PATENT DOCUMENTS

| | | | |
|---|---|---|---|
| JP | 2012-130901 | A | 7/2012 |
| JP | 2014-104441 | A | 6/2014 |
| JP | 2015-080771 | A | 4/2015 |
| JP | 2015-202437 | A | 11/2015 |

OTHER PUBLICATIONS

English Translation of the Written Opinion of the International Searching Authority on International Patent Application No. PCT/JP2016/084129, dated Feb. 7, 2017.

* cited by examiner

NANOBUBBLE GENERATING NOZZLE AND NANOBUBBLE GENERATOR

CROSS REFERENCE TO RELATED APPLICATIONS

This application is a Continuation-in-Part Application of International Application No. PCT/JP2016/084129 filed Nov. 17, 2016, claiming priority based on Japanese Patent Application No. 2016-148510, filed Jul. 28, 2016, the contents of all of which are incorporated herein by reference in their entirety.

FIELD OF THE INVENTION

The present invention relates to a nanobubble generating nozzle and a nanobubble generator. More specifically, the present invention relates to a nanobubble generating nozzle and a nanobubble generator for obtaining a liquid containing nanobubbles which are fine bubbles.

BACKGROUND ART

Liquids containing fine (also referred to as "minute") bubbles called "nanobubbles" are expectedly used in various industrial fields. In recent years, means for generating various nanobubbles have been studied. "Nanobubbles" generally refers to bubbles having a diameter less than 1 μm. Nozzle structures have been studied as representative means for generating nanobubbles. To date, various nozzles for generating nanobubbles have been proposed.

In Patent Document 1, there is proposed a nozzle for obtaining a liquid containing fine bubbles from a pressurized liquid obtained by pressurizing and dissolving a gas. This nozzle comprises a tapered part on an upstream side, a throat part on the upstream side, an enlarged part, a tapered part on a downstream side, and a throat part on the downstream side.

In the tapered part on the upstream side, a nozzle flow path into which the pressurized liquid is supplied gradually decreases in surface area from upstream toward downstream. The throat part on the upstream side is connected to a downstream end portion of the tapered part on the upstream side. The throat part on the upstream side jets the fluid flowing from the tapered part on the upstream side from a jetting port on the upstream side. The enlarged part is connected to the jetting port on the upstream side. The enlarged part enlarges the flow path area. The tapered part on the downstream side is connected to a downstream end of the enlarged part. In the tapered part on the downstream side, the flow path gradually decreases in surface area from upstream toward downstream. The throat part on the downstream side is connected to a downstream end of the tapered part on the downstream side. The throat part on the downstream side jets fluid flowing from the tapered part on the downstream side from a downstream jetting port. That is, this nozzle has a configuration in which a plurality of nozzles is connected in series. In this nozzle, the structure in which the surface area of the flow path gradually decreases pressurizes the liquid containing the gas, dissolving the gas into the liquid. On the other hand, the structure in which the surface area of the flow path is enlarged releases the gas dissolved into the liquid by jetting the liquid containing the gas. Fine bubbles, that is, nanobubbles are generated by such action.

Further, in Patent Document 2, there is proposed a loop flow type bubble producing nozzle. This nozzle comprises a gas-liquid loop flow type agitating and mixing chamber, a liquid supply hole, a gas inflow hole, a gas supply chamber, a first jetting hole, and a second jetting hole, and at least one cut-out part is formed in an end part on the gas-liquid loop flow type agitating and mixing chamber side of a tapered part.

The gas-liquid loop flow type agitating and mixing chamber is an area where a liquid and a gas are agitated and mixed by a looped flow to form a mixed fluid. The liquid supply hole is provided to one end of the gas-liquid loop flow type agitating and mixing chamber. This liquid supply hole supplies the pressurized liquid to the gas-liquid loop flow type agitating and mixing chamber. The gas inflow hole is an area into which the gas flows. The gas supply chamber is provided on the other end side of the gas-liquid loop flow type agitating and mixing chamber. This gas supply chamber supplies the gas into the gas-liquid loop flow type agitating and mixing chamber while circulating the gas that flows from the gas inflow hole around a central axis of the liquid supply hole, from all or a part of locations in the circumferential direction toward the one end described above of the gas-liquid loop flow type agitating and mixing chamber. The first jetting hole is provided to the other end of the gas-liquid loop flow type agitating and mixing chamber. The position of the first jetting hole coincides with the central axis of the liquid supply hole, and the hole diameter is larger than the hole diameter of the liquid supply hole described above. This first jetting hole jets the mixed fluid from the gas-liquid loop flow type agitating and mixing chamber. Then, the second jetting hole is provided so as to continuously increase in diameter from the first jetting hole toward the gas-liquid loop flow type agitating and mixing chamber. The purpose of this loop flow type bubble producing nozzle is to make it possible to improve the bubble production efficiency more than conventional techniques without lowering the bubble production efficiency, even when a liquid containing impurities is used.

PATENT DOCUMENTS

Patent Document 1: Japanese Laid-Open Patent Application No. 2014-104441

Patent Document 2: Japanese Laid-Open Patent Application No. 2015-202437

SUMMARY OF THE INVENTION

Problems to be Solved by the Invention

The fine bubble generating nozzle proposed in Patent Document 1 requires connection of a plurality of nozzle parts in series. Thus, this fine bubble generating nozzle increases the total length, making it very difficult to decrease the length.

On the other hand, the purpose of the loop flow type bubble producing nozzle proposed in Patent Document 2 is to prevent a reduction in bubble production efficiency even when a liquid containing impurities is used. In particular, the purpose of the loop flow type bubble producing nozzle is to suppress a decrease in a supply amount of a gas supplied from the gas supply chamber by precipitation and adherence of sludge or scales composed of impurities. Thus, when nanobubbles are generated using a liquid that does not contain impurities, it is unclear whether or not the nanobubble generation efficiency can be improved.

The present invention has been made to solve the above-described problems, and an object of the present invention is to provide a nanobubble generating nozzle and a nanobubble generator having a compact structure with a short overall length and capable of generating nanobubbles.

Means for Solving the Problems (1) A nanobubble generating nozzle according to the present invention for solving the above-described problems comprises an introduction part for introducing a mixed fluid of a liquid and a gas into an interior thereof, a jetting part for feeding out the mixed fluid containing nanobubbles of the gas, and a nanobubble generating structure part for generating nanobubbles of the gas, between the introduction part and the jetting part. The nanobubble generating structure part comprises a plurality of flow paths having different cross-sectional areas in an axial direction of the nanobubble generating nozzle.

In this invention, a plurality of flow paths having different cross-sectional areas is provided in the axial direction of the nanobubble generating nozzle. Thus, bubble pressurization and release is repeated according to the principles of a pressurizing and dissolving method. Specifically, the bubbles are pressurized and dissolved into the liquid each time the liquid containing bubbles passes through each flow path. Further, the liquid that passes through the flow paths and then flows out from the flow paths is released, thereby making the bubbles contained in the liquid finer. The repetition of this action generates nanobubbles. Furthermore, in the interior of one nozzle, flow paths for pressurizing and dissolving the bubbles into the liquid are provided at a plurality of positions of the nanobubble generating nozzle in the axial direction, and thus connecting a plurality of nozzles in series is not required. Therefore, the nozzle can be compactly configured.

In the nanobubble generating nozzle according to the present invention, the flow paths adjacent to each other in the axial direction of the nanobubble generating nozzle are provided at different positions of the nanobubble generating nozzle in a radial direction.

According to this invention, each flow path is disposed at a different position in the radial direction as described above, and thus the flow paths can be connected to each other in the interior of the nanobubble generating nozzle. The flow paths connected in the interior of the nanobubble generating nozzle pressurize the bubbles contained in the liquid in each flow path, and dissolve the bubbles into the liquid. Further, after the bubbles are dissolved, the liquid into which the gas is dissolved is allowed to flow out from the flow paths and is released. In the present invention, these actions can be imparted independently, allowing the nanobubbles to be generated in each flow path.

In the nanobubble generating nozzle according to the present invention, the plurality of flow paths are disposed in the axial direction of the nanobubble generating nozzle as three flow paths having different cross-sectional areas. The three flow paths comprise a first flow path on an upstream side disposed at a center of the nanobubble generating nozzle in the radial direction, a second flow path of an intermediate position disposed on an outer side of the center of the nanobubble generating nozzle in the radial direction, and a third flow path on a downstream side disposed at the center of the nanobubble generating nozzle in the radial direction.

According to this invention, the nanobubbles can be generated in each flow path from the first flow path to the third flow path.

The nanobubble generating nozzle according to the present invention further comprises a turbulent flow forming part for making the flow of the mixed fluid into a turbulent flow in at least one location between the plurality of flow paths.

According to this invention, the turbulent flow forming part is provided as described above, and makes the flow of the liquid containing the bubbles into a turbulent flow. Thus, a shearing force is applied to the liquid containing the bubbles. Therefore, bubbles contained in the liquid flowing through the turbulent flow forming part are made minute to generate nanobubbles.

In the nanobubble generating nozzle according to the present invention, the turbulent flow forming part comprises a diffusion part for radially diffusing the mixed fluid that flows out from the first flow path toward an outer side of the nanobubble generating nozzle in the radial direction, on a downstream side of an outlet of the first flow path, and the second flow path comprises an inlet disposed at a position that allows the mixed fluid diffused by the diffusion part to return to the first flow path side of the nanobubble generating nozzle in the axial direction.

According to this invention, the turbulent flow forming part is configured as described above, and thus the liquid that flows out from the first flow path is diffused to the outer side in the radial direction by the diffusion part described above. Subsequently, the liquid temporarily returns to the first flow path side, that is, the upstream side and then flows into the second flow path. Thus, a turbulent flow can be formed in a process of returning the liquid to the upstream side. Accordingly, a shearing force is applied to the liquid containing bubbles between the first flow path and the second flow path, thereby allowing the bubbles to be made minute.

(2) A nanobubble generator according to the present invention for solving the above-described problems comprises a circulating part for allowing a liquid to flow therethrough, a gas introducing part for introducing a gas into the circulating part, a pump for feeding out a mixed fluid of the gas and the liquid that flows through an interior of the circulating part, a nanobubble generating nozzle for introducing the mixed fluid fed out by the pump and obtaining a mixed fluid containing nanobubbles of the gas, a liquid storage tank for storing the mixed fluid containing the nanobubbles, and a return path for returning the mixed fluid containing the nanobubbles stored in the liquid storage tank to the circulating part. The nanobubble generating nozzles comprises an introduction part for introducing a mixed fluid of a liquid and a gas into an interior thereof, a jetting part for feeding out the mixed fluid containing nanobubbles of the gas, and a nanobubble generating structure part for generating nanobubbles of the gas, between the introduction part and the jetting part. The nanobubble generating structure part comprises a plurality of flow paths having different cross-sectional areas in an axial direction of the nanobubble generating nozzle.

According to this invention, the nanobubble generator is configured as described above, and thus a circuit through which the liquid flows can be a closed loop circuit. The above-described nanobubble generating nozzle included in this closed loop circuit generates a liquid containing nanobubbles, making it possible to repeatedly generate nanobubbles and store a liquid containing nanobubbles in the liquid storage tank.

In the nanobubble generator according to the present invention, a valve for branching a flow path connecting the pump and the nanobubble generating nozzle, and a bypass flow path for directly communicating the valve and the liquid storage tank are provided between the pump and the nanobubble generating nozzle.

According to this invention, the bypass flow path is provided as described above, and thus the mixed fluid is allowed to flow into the bypass flow path, thereby preventing a pressure between the pump and the nanobubble generating nozzle from rising unnecessarily. As a result, a flow rate of the mixed fluid flowing through the closed loop circuit increases, allowing the gas to be sufficiently incorporated into the closed loop circuit. On the other hand, when nanobubbles are generated and pressure is required by the nanobubble generating nozzle, the bypass flow path is closed, making it possible to increase the pressure of the feeding-out of the pump and feed out the mixed fluid into the nanobubble generating nozzle. Therefore, it is possible to generate nanobubbles from the bubbles contained in the mixed fluid.

Effect of the Invention

According to the present invention, it is possible to configure a nanobubble generating nozzle using a single nozzle, without requiring connection of a plurality of nozzles in series as in prior art. Thus, the nanobubble generating nozzle can be made compact. Further, the nanobubble generator is configured using this nanobubble generating nozzle, making it possible to simplify the structure of the generator.

EMBODIMENTS OF THE INVENTION

Embodiments of the present invention are described below with reference to the drawings. Note that the embodiments described below are examples of the technical ideas of the present invention. The technical scope of the present invention is not limited to the descriptions and drawings below, and includes inventions of the same technical ideas.

[Basic Configuration]

Figure 1:
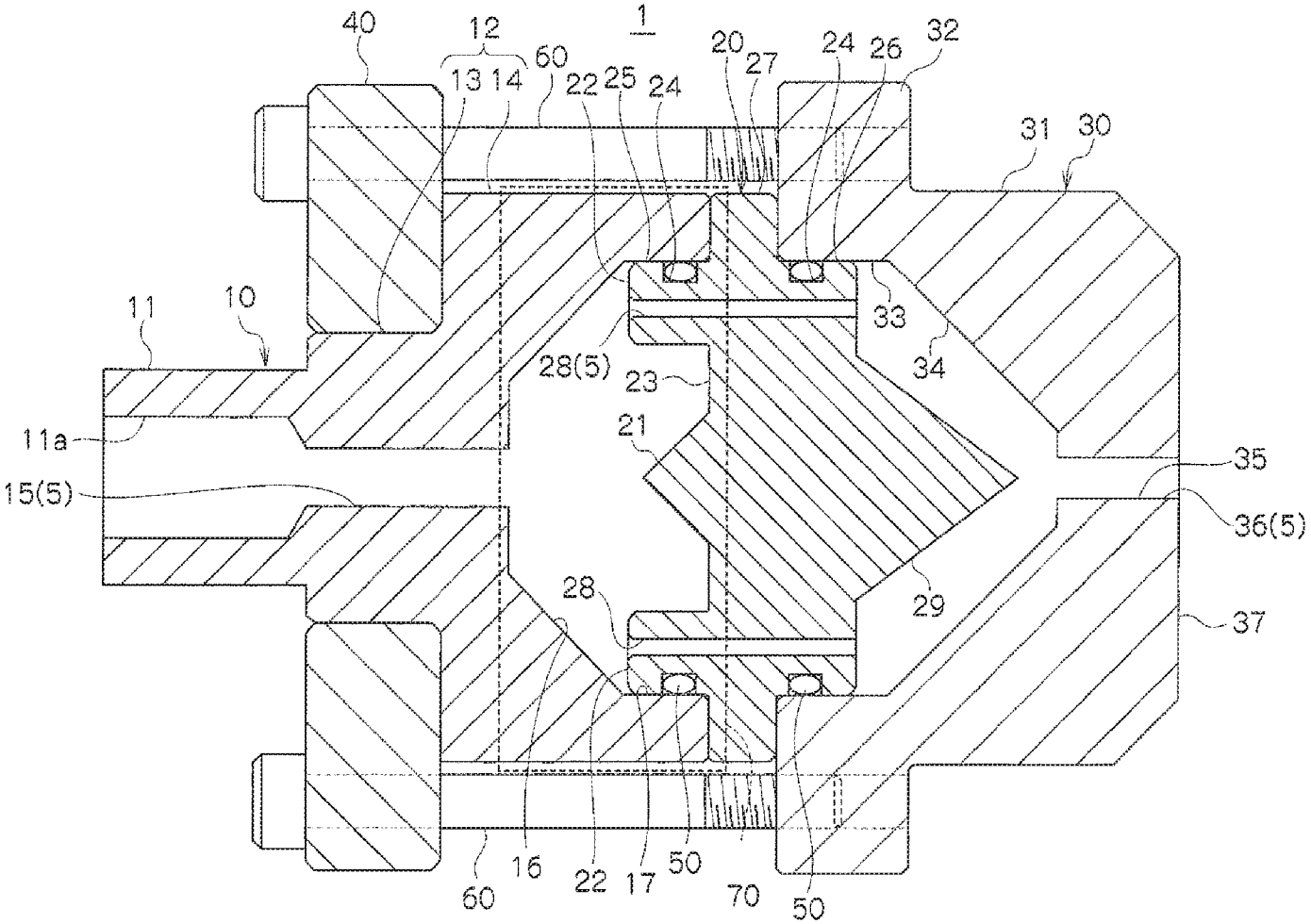
FIG. 1 is a vertical cross-sectional diagram illustrating an embodiment of a nanobubble generating nozzle according to the present invention.

A nanobubble generating nozzle 1 according to the present invention, as illustrated in FIG. 1, comprises an introduction part 11 for introducing a mixed fluid of a liquid and a gas into an interior thereof, and a jetting part 35 for feeding out the mixed fluid containing fine bubbles (nanobubbles). Further, between the introduction part 11 and the jetting part 35, a nanobubble generating structure part 5 for generating nanobubbles is provided. The nanobubble generating structure part 5 comprises a plurality of flow paths 15, 28, 36 having different cross-sectional areas through which the mixed fluid of the liquid and the gas is passed in an axial direction of the nanobubble generating nozzle 1. In other words, the plurality of flow paths 15, 28, 36 are divided and disposed in a plurality of stages in the axial direction of the nanobubble generating nozzle 1, and the cross-sectional areas of the flow paths 15, 28, 36 differ in each stage.

In this specification, "gas" refers to one state of a substance. In this state, neither form nor volume is constant, the substance freely flows, and the volume easily changes by increasing or decreasing the pressure. A gas is the state of a substance prior to changing into bubbles described later. "Bubbles" refers to a spherical substance contained in a liquid, and is a substance having a volume less than that of the gas described above. "Nanobubbles" refers to fine (minute) bubbles having an extremely small sphere diameter.

"Nanobubbles" specifically refers to bubbles having a diameter less than 1 μm. The nanobubbles are maintained in a state contained in a liquid over a long period of time (about several months). In this respect, nanobubbles are different from microbubbles that have a diameter from 1 μm or more and 1 mm or less, and disappear from a liquid after a period of time.

Figure 3:
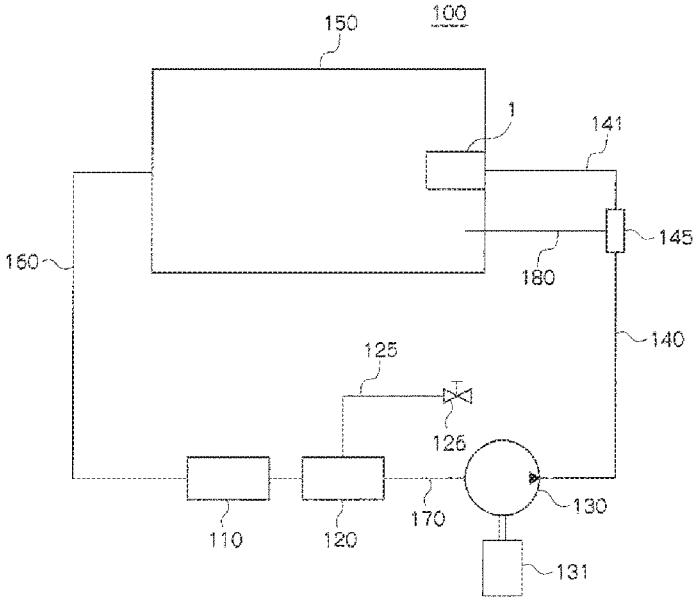
FIG. 3 is a configuration diagram illustrating a configuration of an embodiment of a nanobubble generator according to the present invention by modeling.

A nanobubble generator 100 according to the present invention, as illustrated in FIG. 3, comprises a gas introducing part 120, a pump 130, the nanobubble generating nozzle 1, a liquid storage tank 150, and a return path 160. The gas introducing part 120 is a component for introducing a gas into a circulating part 170 for allowing a liquid to flow therethrough. The pump 130 feeds out a mixed fluid of the gas and the liquid that flows from the interior of the circulating part 170. The nanobubble generating nozzle 1 introduces the mixed fluid fed out by the pump 130, and obtains a mixed fluid containing nanobubbles. The liquid storage tank 150 stores the mixed fluid containing nanobubbles. Then, the return path 160 returns the mixed fluid stored in the liquid storage tank 150 to the circulating part 170. The nanobubble generating nozzle 1 used in the nanobubble generator 100 is the nozzle illustrated in FIG. 1 described above.

According to the nanobubble generating nozzle 1 of the present invention, it is possible to configure a nanobubble generating nozzle using a single nozzle, without requiring connection of a plurality of nozzles in series as in prior art. Thus, the nanobubble generating nozzle can be made compact. Further, the nanobubble generator 100 is configured using this nanobubble generating nozzle, and thus the structure of the generator can be simplified.

Specific configurations of the nanobubble generating nozzle 1 and the nanobubble generator 100 are described below.

[Nanobubble Generating Nozzle]

FIG. 1 illustrates an example of a configuration of the nanobubble generating nozzle 1. The nanobubble generating nozzle 1 of the example illustrated in FIG. 1 is mainly configured by three components. Specifically, the nanobubble generating nozzle 1 is configured by an introduction part constituent 10, an intermediate part constituent 20, and a jetting part constituent 30. The introduction part constituent 10 comprises an introduction port for introducing a mixed fluid of a liquid and a gas into the interior thereof. The jetting part constituent 30 comprises a jetting port for jetting the mixed fluid containing the nanobubbles. The intermediate part constituent 20 is sandwiched between these two constituents 10, 30.

The nanobubble generating nozzle 1 is obtained by combining these three components, and thus the plurality of flow paths 15, 28, 36 having different cross-sectional areas of the transverse sections are arranged in the axial direction of the nanobubble generating nozzle 1. Further, in each of the flow paths 15, 28, 36, the flow paths 15, 28, 36 adjacent to each other in the axial direction are respectively formed at different positions of the nanobubble generating nozzle 1 in the radial direction.

Specifically, in the nanobubble generating nozzle 1 illustrated in FIG. 1, the flow paths 15, 28, 36 are divided and disposed in three different locations of the nanobubble generating nozzle 1 in the axial direction. Then, the first flow path 15 on the upstream side is formed in the center of the nanobubble generating nozzle 1 in the radial direction, the second flow paths 28 of the intermediate position are formed on the outer side of the center of the nanobubble generating nozzle 1 in the radial direction, and the third flow path 36 on the downstream side is formed in the center of the nanobubble generating nozzle 1 in the radial direction. Further, the cross-sectional areas of the transverse sections of these flow paths 15, 28, 36 are different from each other.

Further, in the nanobubble generating nozzle 1, a turbulent flow forming part 70 for making the flow of the mixed fluid of the liquid and the gas into a turbulent flow is provided in at least one location between the flow paths 15, 28, 36.

<Introduction Part Constituent>

The introduction part constituent 10 is a component that constitutes the upstream side of the nanobubble generating nozzle 1. The introduction part constituent 10 comprises an introduction port for introducing a mixed fluid of a liquid and a gas into the interior thereof. The introduction part constituent 10 is configured by a main body part 12, and the introduction part 11 protruding from an end surface of the main body part 12. The main body part 12 has an outer shape obtained by stacking two columnar areas having different diameters in the axial direction. A small diameter area 13 constitutes the upstream side, and a large diameter area 14 constitutes the downstream side. In the interior of the main body part 12, the first flow path 15 and an area having a tapered inner surface (tapered portion 16) constituting a part of the turbulent flow forming part 70 are formed. Further, a straight portion 17 is formed in a portion on the downstream side of the large diameter area 14. This straight portion 17 is an area for fitting the intermediate part constituent 20 into an inner side of the large diameter area 14. The diameter of the introduction part 11 is formed even less than the small diameter area 13, and the introduction part 11 protrudes from an end surface of the small diameter area 13 toward the outer side.

(Introduction Part)

The introduction part 11 is an area for introducing a mixed fluid of the liquid and the gas fed out by the pump 130 into the interior of the nanobubble generating nozzle 1. The introduction part 11 has a cylindrical shape, and protrudes from the end surface of the small diameter area 13 in the axial direction of the nanobubble generating nozzle 1. An introduction passage 11*a* is formed in the interior of the introduction part 11, and introduces the mixed fluid into the interior. A pipe or hose 140 connected to the pump 130 is connected to this introduction part 11.

(Small Diameter Area)

The first flow path 15 is formed in the interior of the small diameter area 13. The first flow path 15 extends in the axial direction at the center of small diameter area 13 in the radial direction. The inner diameter of the first flow path 15 is formed smaller than that of the introduction passage 11*a*. The inner diameter of the flow path 15 is preferably formed to 5 to 10 mm, inclusive. In the nanobubble generating nozzle 1 of the example illustrated in FIG. 1, the inner diameter of the first flow path 15 is formed to 5 mm The first flow path 15 has a function of changing gas into small bubbles (nanobubbles) and making liquid contain nanobubbles by passing the mixed fluid of the liquid and the gas through the interior thereof. That is, the first flow path 15, when the mixed fluid passes through the first flow path 15, pressurizes the gas contained in the mixed fluid, dissolves the gas into the liquid and, once the mixed fluid passes through the first flow path and is fed out from the first flow path, releases the mixed fluid. The first flow path 15 changes the gas contained in the mixed fluid into nanobubbles, which are minute bubbles, by this action.

(Large Diameter Area)

The large diameter area 14 is formed with a concave part recessed from an end surface on the intermediate part constituent 20 side (downward side) of the introduction part constituent 10 toward the introduction part 11. An inner surface of the concave part is configured by the straight portion 17 and the tapered portion 16. The straight portion 17 is formed parallel with the axial direction and extends in a straight manner. The tapered portion 16 has a tapered shape that narrows from the intermediate part constituent 20 side (downstream side) toward the first flow path 15 side (upstream side).

The straight portion 17 is formed in a region occupying the intermediate part constituent 20 side (downstream side) of the concave part. This straight portion 17 is an area fitted into the intermediate part constituent 20 when the three constituents are combined.

The tapered portion 16 is formed in the inner section of concave part, that is, on the first flow path 15 side (upstream side). The tapered portion 16, as described above, is formed into a narrowed shape from the intermediate part constituent 20 side (downstream side) toward the first flow path 15 side (upstream side). In other words, the tapered portion 16 has a shape that gradually widens toward the outer side in the radial direction, from the first flow path 15 side (upstream side) toward the downstream side. Then, the tapered portion 16 is connected to the first flow path 15 at the innermost position of the tapered portion 16, that is, in a portion closest to the first flow path 15. Thus, the tapered portion 16 is configured to allow the mixed fluid that flows out from the first flow path 15 to flow toward the center or the outer side in the radial direction.

<Intermediate Part Constituent>

The intermediate part constituent 20 is a component having a disk shape or a substantially disk shape as a whole. The intermediate part constituent 20 is sandwiched between the introduction part constituent 10 described above and the jetting part constituent 30 described later. Protruding parts 21, 29 having conical shapes on both surfaces in a thickness direction are respectively formed in the central part of the intermediate part constituent 20 in the radial direction. The first protruding part 21 having a conical shape and formed on the introduction part constituent 10 side (upstream side) constitutes a part of the turbulent flow forming part 70. Conversely, the second protruding part 29 having a conical shape and formed on the jetting part constituent 30 side (downstream side) has a function of a guide passage for guiding the mixed fluid to the third flow path 36.

On the other hand, a ring-shaped protruding part 22 protruding toward the introduction part constituent 10 side (upstream side) is formed in an area on the outer side in the radial direction. This ring-shaped protruding part 22 is formed over an entire circumference of the intermediate part constituent 20, having a ring shape. The second flow paths 28 are formed on the ring-shaped protruding part 22.

(First Protruding Part)

The first protruding part 21 constitutes a part of the turbulent flow forming part 70. The first protruding part 21 is formed into a conical shape, and a position of a tip end thereof corresponds to the center of the first flow path 15. The first protruding part 21 causes the mixed fluid that flows out from the first flow path 15 to radially flow from the center toward the outer side in the radial direction. That is, the first protruding part 21 has a function of causing the mixed fluid that flows out from the first flow path 15 to flow in the direction in which the second flow paths 28 are arranged.

(Second Flow Path)

The second flow paths 28 are formed at the position of the ring-shaped protruding part 22 as described above. The plurality of second flow paths 28 are formed at the position of the ring-shaped protruding part 22 at equal intervals in the circumferential direction.

Inner diameters of the second flow paths 28 are respectively formed smaller than an inner diameter of the first flow path 15. Further, the second flow paths 28 are formed so that the total of the cross-sectional areas of the transverse sections of the plurality of second flow paths 28 is smaller than the cross-sectional area of the transverse section of the first flow path 15. Note that the inner diameters of the second flow paths 28 are set according to the number of the second flow paths 28. That is, the inner diameters of the second flow paths 28 are formed smaller when a larger number of the second flow paths 28 is formed, and the inner diameters of the second flow paths 28 are formed larger when a smaller number of the second flow paths 28 is formed. For example, when the second flow paths 28 are formed in four to 16 locations in the circumferential direction, the inner diameters are preferably formed to 1 to 2 mm, inclusive. In the nanobubble generating nozzle 1 of the example illustrated in FIG. 1, the second flow paths 28, each having an inner diameter of 1 mm, are provided in 16 locations in the circumferential direction.

With the second flow paths 28 being formed on the ring-shaped protruding part 22, as illustrated in FIG. 1, inlets of the second flow paths 28 are positioned on the introduction part constituent 10 side (upstream side) of an end surface 23. Thus, the mixed fluid is flowed out from the first flow path 15, and radially spreads by the first protruding part 21. Then, the mixed fluid collides with an inner wall of the ring-shaped protruding part 22 and temporarily flows back toward the upstream side. The mixed fluid becomes a turbulent flow at that time. Then, the mixed fluid that becomes a turbulent flow flows from the inlets of the second flow paths 28 positioned on the introduction part constituent 10 side (upstream side) of the end surface 23 into the interior of the second flow paths 28.

The second flow paths 28 have a function of making the gas and the large diameter bubbles contained in the mixed fluid flowing through the interior thereof into even smaller bubbles. That is, the large diameter bubbles formed by the first flow path 15 and the gas not changed into bubbles are further pressurized and dissolved into the liquid when passing through the second flow paths 28. Further, the liquid into which the gas is dissolved flows out from the second flow paths 28 after passing through the second flow paths 28 and is released, changing the liquid into small diameter bubbles.

(Second Protruding Part)

The second protruding part 29 is formed into a conical shape that narrows toward the jetting part constituent 30. This second protruding part 29 has a function of a circulating path for guiding the mixed fluid that flows out from the second flow paths 28 to the third flow path 36.

(Outer Peripheral Part)

The intermediate part constituent 20 is formed with a flange portion 27 projecting toward the outer side on the outer periphery thereof, in the center in the axial direction. Then, a seal groove 24 is formed over the entire circumference of the outer periphery, in the portions on both sides sandwiching the flange portion 27. An O-ring 50 is fitted into this seal groove 24.

<Jetting Part Constituent>

The jetting part constituent 30 is a constituent for jetting the mixed fluid containing the nanobubbles from the nanobubble generating nozzle 1 to the exterior. The jetting part constituent 30 comprises a jetting port for jetting the mixed fluid containing the nanobubbles. This jetting part constituent 30 comprises a main body part 31 and a flange part 32. Further, the jetting part constituent 30 comprises the third flow path 36.

(Main Body Part)

The main body part 31 is an area having a columnar or substantially columnar outer shape. This main body part 31 has a concave part recessed from one end side toward the other end side in the axial direction. The concave part comprises an area (straight portion 33) for fitting the jetting part constituent 30 into the intermediate part constituent 20, and an area (tapered portion 34) for forming a circulating path through which the mixed fluid containing the nanobubbles flows.

Specifically, the concave part is configured by the straight portion 33 and the tapered portion 34. The straight portion 33 extends in a straight manner from the end part on one end side toward the other end side. The tapered portion 34 has a shape that narrows from the position on the innermost side of the straight portion 33 toward the other end side. The straight portion 33 is an area for fitting the jetting part constituent 30 into the intermediate part constituent 20, and the tapered portion 34 is an area for forming a flow path through which the liquid flows.

Further, the third flow path 36 formed in the central part in the radial direction is provided in an area on the downstream side of the concave part. The third flow path 36 communicates the innermost position of the tapered portion 34 forming the concave part, and an end surface 37 of the jetting part constituent 30 itself.

The inner diameter of the third flow path 36 is formed to 3 to 4 mm, inclusive. The lower limit of the inner diameter of the third flow path 36 is particularly important. When the inner diameter is formed smaller than 3 mm, the pressure of the liquid rises unnecessarily, possibly hindering generation of nanobubbles. Thus, the inner diameter of the third flow path 36 is preferably 3 mm or greater.

Here, a ratio of the cross-sectional areas of the first flow path, the second flow path, and the third flow path is described. In this nanobubble generating nozzle, the cross-sectional areas of the flow paths are formed to a ratio of (cross-sectional area of first flow path): (cross-sectional area of second flow path): (cross-sectional area of third flow path)=about 3:2:1. With the cross-sectional area formed to this ratio, it is possible to generate nanobubbles very effectively.

(Flange Part)

The flange part 32 projects from the main body part 31 toward the outer side in the radial direction, on one end side of the main body part 12. This flange part 32 is an area used when the introduction part constituent 10, the intermediate part constituent 20, and the jetting part constituent 30 serving as the three constituents are combined. Specifically, the three constituents are combined using bolts 60. A plurality of holes is formed in the flange part 32, and the three constituents are combined by passing the bolts 60 through these holes.

(Holder)

The nanobubble generating nozzle 1 of the example illustrated in FIG. 1 further comprises a holder 40 in addition to the introduction part constituent 10, the intermediate part constituent 20, and the jetting part constituent 30 described above. This holder 40 is a member used when the three constituents are combined.

The holder 40 has an annular shape, and holes are formed in a plurality of locations in the circumferential direction. The number of holes is the same as the number of holes formed in the flange part 32 of the jetting part constituent 30. The bolts 60 are passed through these holes.

<Assembly of Three Constituents>

As described above, the nanobubble generating nozzle 1 is configured by the introduction part constituent 10, the intermediate part constituent 20, the jetting part constituent 30, and the holder 40. The nanobubble generating nozzle 1 is assembled as follows.

First, the straight portion 17 of the introduction part constituent 10 is fitted into an upstream side outer circumferential surface area 25 formed on the outer circumferential surface of the intermediate part constituent 20, on the upstream side of the flange portion 27. Further, the straight portion 33 of the jetting part constituent 30 is fitted into a downstream side outer circumferential surface area 26 formed on the outer circumferential surface of the intermediate part constituent 20, on the downstream side of the flange portion.

The seal groove 24 is formed on the outer circumferential surface of the intermediate part constituent 20, and the O-ring 50 is fitted into this seal groove 24. Thus, when the straight portion 17 of the introduction part constituent 10 and the straight portion 33 of the jetting part constituent 30 are respectively fitted into the outer circumferential surface areas 25, 26 of the intermediate part constituent 20, mating surfaces of the intermediate part constituent 20 and the introduction part constituent 10, and mating surfaces of the intermediate part constituent 20 and the jetting part constituent 30 are sealed by the O-rings 50. As a result, when the liquid flows into the interior of the nanobubble generating nozzle 1, leakage from the respective mating surfaces by the liquid of the interior is prevented.

Next, the holder 40 is fitted into the small diameter area 13 of the introduction part constituent 10. A surface of the fitted holder 40 on the downstream side is abutted to the end surface of the columnar small diameter area 13.

Next, the bolts 60 are passed through the holes formed in the holder 40 and the holes formed in the flange part 32 of the jetting part constituent 30. Female threads are formed in the holes formed in the flange part 32, and tip ends of the bolts 60 are tightened into these female threads.

Thus, the nanobubble generating nozzle 1 is assembled via the steps described above.

<Action of Nanobubble Generating Nozzle>

Next, the action of the nanobubble generating nozzle 1 is described with reference to FIG. 2.

The introduction part 11 introduces a mixed fluid of a liquid and a gas into the interior of the nanobubble generating nozzle 1. Specifically, the introduction part 11 allows a mixed fluid supplied from a hose or a pipe connected thereto to pass through the introduction passage 11*a* of the introduction part 11, and introduces the mixed fluid into the first flow path 15.

The first flow path 15 pressurizes the gas contained in the mixed fluid that flows into the interior thereof to dissolve the gas into the liquid, and releases the mixed fluid that flows out from the first flow path 15. Thus, in the first flow path 15, the gas that flows into the interior thereof changes into small bubbles. Then, in the first flow path 15, the mixed fluid containing the small bubbles flows out to the turbulent flow forming part 70.

The turbulent flow forming part 70 radially diffuses the mixed fluid that flows therein, from the center toward the outer side in the radial direction, by the first protruding part 21. Specifically, the first protruding part 21 having a conical shape causes the mixed fluid that flows therein from the tip end side to flow along the peripheral surface, and changes a direction of the flow from the center side toward the outer side in the radial direction. The first protruding part 21 allows the mixed fluid that flows along the peripheral surface to flow further toward the outer side.

The inlets of the second flow paths 28 formed on the ring-shaped protruding part 22 are formed on the introduction part constituent 10 side (upstream side) of the end surface 23 of the intermediate part constituent 20. Thus, the mixed fluid that flows through the end surface 23 of the intermediate part constituent 20 is prohibited from directly flowing into the second flow paths 28. As a result, the inner wall surface of the ring-shaped protruding part 22 causes the mixed fluid that flows along the peripheral surface of the first protruding part 21 and the peripheral surface of the end surface 23 to collide, changing the direction of the flow of the liquid to the first flow path 15 side. Then, a space portion surrounded by the tapered portion 16 of the introduction part constituent 10 and the intermediate part constituent 20 disrupts the flow of the mixed fluid and produces a turbulent flow. This turbulent flow forming part 70 makes the flow of the mixed fluid containing bubbles into a turbulent flow, and thus causes a shearing force to act on the gas and the large diameter bubbles contained in the mixed fluid. Therefore, even in this turbulent flow forming part 70, small diameter bubbles are generated.

The second flow paths 28 formed on the ring-shaped protruding part 22 cause the mixed fluid that becomes a turbulent flow in the space portion surrounded by the tapered portion 16 of the introduction part constituent 10 and the intermediate part constituent 20 to flow therein. The mixed fluid that flows into the second flow paths 28 passes through the second flow paths 28, and flows out to the jetting part constituent 30 side (downstream side). While the mixed fluid containing gas and large diameter bubbles flows through the interior of the second flow paths 28, the second flow paths 28 pressurize and dissolve the gas and the large diameter bubbles into the liquid. Moreover, the second flow paths 28 are formed so that each inner diameter is smaller than the inner diameter of the first flow path 15, and the total of the cross-sectional areas of the transverse sections of the second flow paths 28 is smaller than the cross-sectional area of the transverse section of the first flow path 15. The liquid into which the gas is dissolved flows out and is released after passing through the second flow paths 28 having such small cross-sectional areas, and thus bubbles having smaller diameters than those in the first flow path are generated.

The space portion formed by the tapered portion 34 of the jetting part constituent 30 and the intermediate part constituent 20 functions as a flow path for guiding the mixed fluid that flows out from the second flow paths 28 to the third flow path 36. That is, the mixed fluid that flows out from the second flow paths 28 flows along the flow path formed by the peripheral surface of the second protruding part of the intermediate part constituent 20 and the inner surface of the tapered portion 34 of the jetting part constituent 30, and is guided to the inlet of the third flow path 36 positioned in the center in the radial direction.

The third flow path 36 functions as a jetting part 35 that allows the mixed fluid containing gas and large diameter bubbles to pass therethrough, and jets the mixed fluid to the exterior of the nanobubble generating nozzle 1. This third flow path 36, similar to the first and second flow paths 15, 28, pressurizes the gas and the large diameter bubbles, dissolving the gas and the bubbles into the liquid. The gas and the bubbles, after passing through the third flow path, are jetted from the nanobubble generating nozzle 1 and released. Thus, the third flow path 36 generates nanobubbles, which are minute diameter bubbles. Moreover, the cross-sectional area of the transverse section of this third flow path 36 is smaller than the total of the cross-sectional areas of the transverse sections of the second flow paths 28. Therefore, the third flow path 36 appropriately pressurizes the mixed fluid passing through the interior thereof, increasing the pressure of the passing mixed fluid. As a result, the gas and the large diameter bubbles contained in the mixed fluid are appropriately pressurized and dissolved into the liquid. Further, the third flow path 36 increases the pressure of the mixed fluid, and thus imparts a moderate flow velocity to the mixed fluid, jetting the mixed fluid from the nanobubble generating nozzle 1 at a predetermined flow velocity.

In this nanobubble generating nozzle, the first flow path and the second flow path are formed at different positions of the nanobubble generating nozzle in the radial direction. Similarly, the second flow paths and the third flow path are disposed at different position in the radial direction. Thus, when the positions in which the flow paths are formed are shifted in the radial direction, the flow paths are connected in the internal space of the nanobubble generating nozzle. Therefore, the gas and the large diameter bubbles contained in the liquid are pressurized in each of the flow paths and dissolved into the liquid. Further, the liquid flows out and is released after passing through the flow paths, reliably forming nanobubbles in each of the flow path.

When the flow paths are formed at different positions in the radial direction as in the nanobubble generating nozzle 1 of the present embodiment, the dimensions in the axial direction can be shortened compared to when the flow paths are formed at the same positions in the radial direction. As a result, the advantage that the nanobubble generating nozzle 1 can be compactly formed is obtained. In this case, as in the nanobubble generating nozzle of the present embodiment, the inner diameters of the first flow path positioned on the upstream side and the third flow path positioned on the downstream side are formed larger than the inner diameters of the second flow paths positioned in the intermediate part. Then, the first flow path and the third flow path are configured by one hole, and the second flow paths are configured by a plurality of holes.

The nanobubble generating nozzle 1 pressurizes the mixed fluid of the liquid and the gas and then jets and releases the mixed fluid by the action described above, thereby reliably generating nanobubbles.

[Nanobubble Generator]

The nanobubble generator 100, as illustrated in FIG. 3, comprises a closed loop circuit in which a mixed fluid containing nanobubbles of a gas is circulated. The closed loop circuit comprises the gas introducing part 120, the pump 130, the nanobubble generating nozzle 1, the liquid storage tank 150, and the return path 160. The gas introducing part 120 is a component for introducing a gas into the circulating part 170 through which a liquid flows. The pump 130 feeds out the mixed fluid of the gas and the liquid toward the subsequent nanobubble generating nozzle 1. The nanobubble generating nozzle 1 introduces the mixed fluid fed out by the pump 130, and generates a mixed fluid containing nanobubbles of the gas. The liquid storage tank 150 is a component for storing the mixed fluid containing nanobubbles. The return path 160 returns the mixed fluid stored in the liquid storage tank 150 to the circulating part 170 described above.

The nanobubble generating nozzle 1 used here is the nanobubble generating nozzle 1 according to the present invention described heretofore. The configuration of the nanobubble generating nozzle 1 has already been described, and thus a description thereof is omitted here.

Further, the nanobubble generator 100, as illustrated in FIG. 3, branches from the hose or pipe 140, and comprises a bypass flow path 180 connected to the liquid storage tank 150.

Each configuration of the nanobubble generator 100 is described below. Note that the section between the return path 160 and the pump 130 in the closed loop circuit is referred to as "circulating part 170" in the description.

(Gas Introducing Part)

The gas introducing part 120 is a component for introducing a gas into the circulating part 170 of the closed loop circuit. In the example of the nanobubble generator 100 illustrated in FIG. 3, the gas introducing part 120 is provided at the position of the circulating part 170 between the return path 160 and the pump 130.

The gas introducing part 120 used is, for example, an ejector. The ejector is a component provided with a main line through which the liquid flows, and a suction port that suctions the gas. The main line of the ejector is provided with a nozzle and a diffuser. The ejector mixes the gas into the liquid in the main line at the position of the outlet of the nozzle. Then, the ejector is structured to feed the mixed liquid and gas to the downstream side by the diffuser.

Note that the nozzle of the ejector is a component that decreases a kinetic energy of the fluid and increases a pressure energy, and the diffuser is a component that transforms the kinetic energy of the fluid into a pressure energy.

A hose or pipe 125 is connected to the suction port. This hose or pipe 125 is connected to feed the gas to the ejector. Further, the hose or pipe 125 is provided with a switch valve 126 at a tip end thereof. This switch valve 126 connects and disconnects a supply source of the gas and the hose or pipe 125. Note that the used supply source of the gas, while not particularly illustrated, is a preferred gas cylinder, such as an oxygen cylinder, for example.

In the nanobubble generator 100 of this embodiment, when an ejector is used as the gas introducing part 120, the gas can be effectively mixed into the mixed fluid without changing the pressure of the mixed fluid flowing through the circulating part 170, before or after the ejector of the circulating part 170.

(Pump)

The pump 130 circulates the mixed fluid of the closed loop circuit in this closed loop circuit. In the nanobubble generator 100 of the example illustrated in FIG. 3, a centrifugal pump 130 is used as the pump. This centrifugal pump 130 is driven by a motor 131 serving as the power source. Note that while a centrifugal pump is used as the pump in the example illustrated in FIG. 3, the type of pump 130 used is not particularly limited. One distinctive feature of the nanobubble generator 100 of this embodiment is that the type of the pump 130 used is not limited. However, preferably the pump 130 used is an appropriate pump in accordance with the type of liquid and the type of gas.

(Nanobubble Generating Nozzle)

In the nanobubble generating nozzle 1, the nozzle of the embodiment illustrated in FIG. 1 is used, for example. That is, the nozzle comprises the nanobubble generating structure part 5 described above in the nozzle interior. This nanobubble generating structure part 5 comprises the plurality of flow paths 15, 28, 36 having different cross-sectional areas through which the mixed fluid is passed. Specifically, the nanobubble generating structure part 5 comprises the plurality of flow paths 15, 28, 36 having different cross-sectional areas in the axial direction of the nanobubble generating nozzle 1. Note that the details of the nanobubble generating nozzle 1 have already been described with reference to FIG. 1 and FIG. 2, and thus descriptions thereof are omitted here.

(Liquid Storage Tank)

The liquid storage tank 150 is a component for storing the mixed fluid containing the nanobubbles generated by the nanobubble generating nozzle 1. The liquid storage tank 150 used is a tank of a size corresponding to the required amount of the mixed fluid containing nanobubbles. The pump 130 and the liquid storage tank 150 described above are connected by the pipe or hose 140. As a result, a part of the closed loop circuit is configured.

(Attachment Mode of Nanobubble Generating Nozzle)

Figure 4:
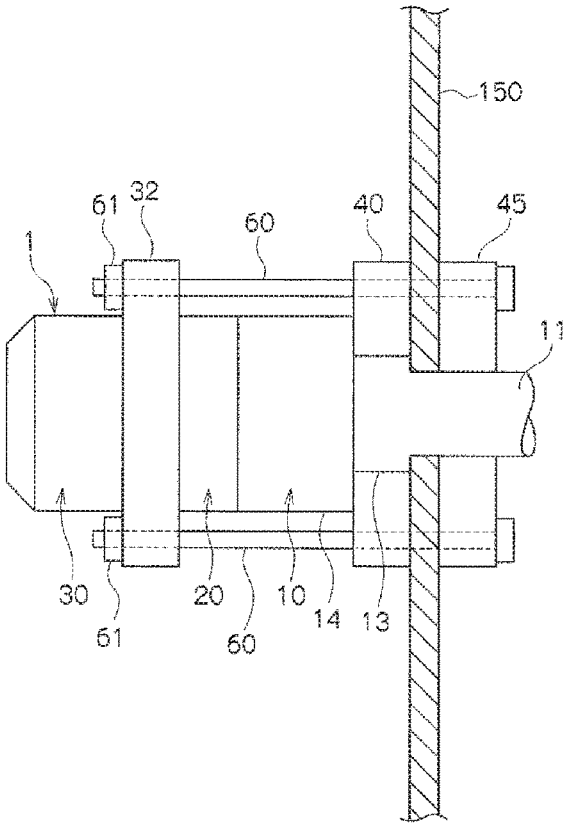
FIG. 4 is an explanatory diagram for explaining an attachment mode of the nanobubble generating nozzle.

FIG. 4 illustrates an example of the attachment mode of the nanobubble generating nozzle 1. In the attachment mode illustrated in FIG. 4, the nanobubble generating nozzle 1 is disposed in the interior of the liquid storage tank 150, and fixed to the peripheral wall surface of the liquid storage tank 150.

Specifically, the nanobubble generating nozzle 1 is attached to the peripheral wall surface of the liquid storage tank 150 as follows. The introduction part 11 is passed through a hole formed on the peripheral wall surface of the liquid storage tank 150. At this time, the third flow path (not illustrated) formed in the jetting part constituent 30 is directed to the interior of the liquid storage tank 150. Then, the end surface of the holder 40 and the end surface of the small diameter area 13 are abutted to an inner surface of the peripheral wall surface of the liquid storage tank 150.

Further, a holder 45 having an annular shape is disposed on an outer side of the peripheral wall surface of the liquid storage tank 150. The introduction part 11 of the nanobubble generating nozzle 1 is inserted into a space portion formed in the center of the holder 45. Then, one end of the holder 45 in a thickness direction is abutted to the outer surface of the peripheral wall surface of the liquid storage tank 150. A plurality of holes is formed in this holder 45, passing through the thickness direction thereof, and the holder 45 is configured so that the bolts are passed therethrough.

The bolts 60 are passed through the holes of the holder 45 disposed on the outer side of the peripheral wall surface, the holes of the holder 40 disposed on the inner side of the peripheral wall surface, and the holes of the flange part 32. Then, nuts 61 are tightened on the tip ends of the bolts 60, and the peripheral wall surface is sandwiched by the holder 40 and the nanobubble generating nozzle 1, thereby fixing the nanobubble generating nozzle 1 to the peripheral wall surface of the liquid storage tank 150.

(Return Path)

The return path 160 is configured by piping. The return path 160 constitutes a part of the closed loop circuit. Specifically, the return path 160 connects the liquid storage tank 150 and the circulating part 170. This return path 160 returns the mixed fluid containing nanobubbles and stored in the liquid storage tank 150 to the circulating part 170 once again. Further, the return path 160 introduces gas by the ejector provided to the circulating part 170 once again.

The nanobubble generator 100 of this embodiment circulates the liquid containing nanobubbles, thereby increasing the ratio occupied by the nanobubbles contained in the liquid.

(Bypass Flow Path)

The bypass flow path 180 communicates a middle portion of the pipe or hose 140 in a longitudinal direction, and the liquid storage tank 150. Specifically, a valve 145 for branching the flow of the mixed fluid flowing through the interior of the pipe or hose 140 is provided to the middle portion of the pipe or hose 140 in the longitudinal direction. This valve 145 branches the pipe or hose 140 to a main flow path 141 and the bypass flow path 180.

The valve 145 adjusts the flow rates so that the flow rate of the liquid branched to the bypass flow path 180 is less than the flow rate of the mixed fluid flowing through the main flow path 141. The bypass flow path 180 branched by the valve 145 directly guides the nanobubbles flowing through closed loop circuit from the pipe or hose 140 to the liquid storage tank 150.

This nanobubble generator 100 circulates the liquid containing nanobubbles in the closed loop circuit, making it possible to cause the liquid to contain a great amount of nanobubbles. Further, the nanobubble generator 100, provided with the bypass flow path 180, keeps the pressure in the closed loop circuit from rising unnecessarily. As a result, the gas does not dissolve into the liquid, and nanobubbles are appropriately generated.

In the nanobubble generating nozzle and the nanobubble generator described above, examples of the liquid used include water, a liquid containing a liquid other than water in water, and a liquid other than water. Examples of a liquid to be contained in water include a nonvolatile liquid such as ethyl alcohol. Further, examples of a liquid other than water include ethyl alcohol. On the other hand, examples of the gas include air, nitrogen, ozone, oxygen, and carbon dioxide.

[Confirmation Test]

Nanobubbles were generated by the nanobubble generator using the nanobubble generating nozzle of the present embodiment, and the number of generated nanobubbles was then measured for each nanobubble diameter.

The confirmation test was performed using the generator of two embodiments: generating nanobubbles using the nanobubble generator 100 (generator of the first embodiment) without the bypass flow path 180, and generating nanobubbles using the nanobubble generator 100 (generator of the second embodiment) with the bypass flow path 180. Specifically, in the nanobubble generator 100 of the first embodiment, nanobubbles were generated using oxygen as the gas and water as the liquid. On the other hand, in the nanobubble generator 100 of the second embodiment, nanobubbles were generated using ozone as the gas and water as the liquid. The nanobubble generating nozzle 1 used in the test is the nozzle illustrated in FIG. 1. The nanobubble generator 100 used is the generator illustrated in FIG. 3. The nanobubbles were generated by running the nanobubble generator for a certain period of time, circulating the mixed fluid of water and oxygen first, and circulating the mixed fluid of water and ozone second.

The nanobubbles were confirmed by measuring the quantity and size of the bubbles contained per milliliter by nanoparticle tracking analysis using a LM 10-type measuring instrument manufactured by Malvern Instruments Ltd.

Figure 5:
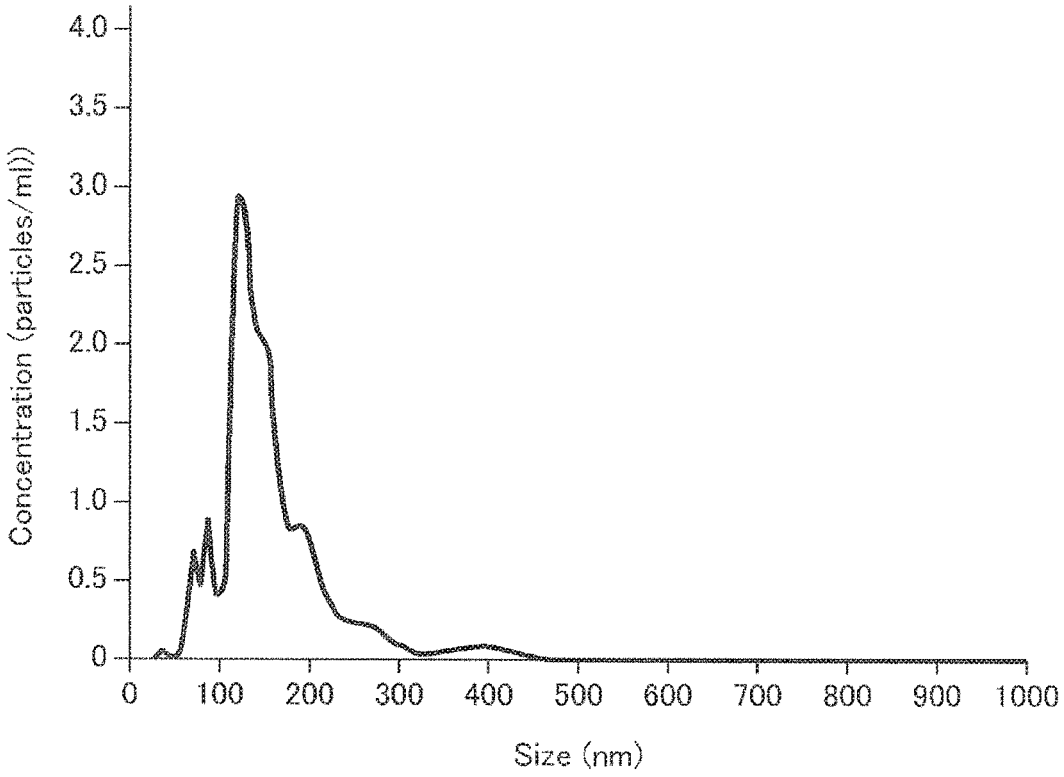
FIG. 5 is a graph showing the relationship between a diameter of nanobubbles generated by the nanobubble generator without use of a bypass circuit, and a quantity of nanobubbles generated.
Figure 6:
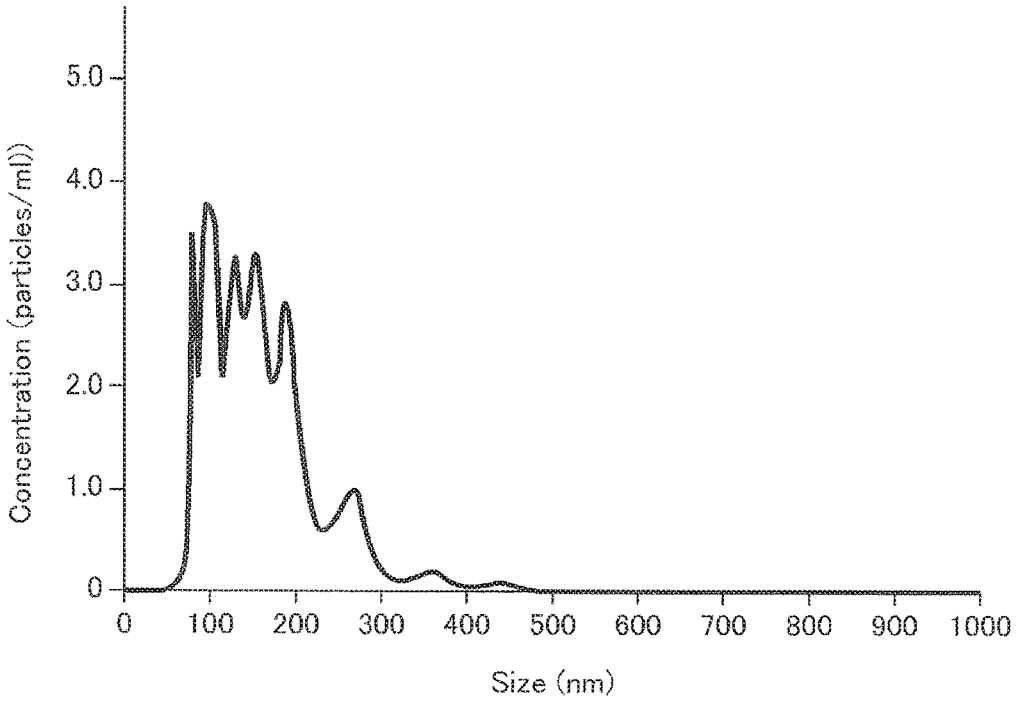
FIG. 6 is a graph showing the relationship between the diameter of nanobubbles generated by the nanobubble generator with use of a bypass circuit, and the quantity of nanobubbles generated.

FIG. 5 shows the measurement results when oxygen is used as the gas, using the nanobubble generator 100 without use of the bypass flow path 180. FIG. 6 shows the measurement results when ozone is used as the gas, using the nanobubble generator 100 with use of the bypass flow path 180. In FIG. 5 and FIG. 6, the horizontal axis indicates the diameter of the bubbles, and the vertical axis indicates the number of nanobubbles contained per milliliter.

When nanobubbles were generated using oxygen as the gas without use of the bypass flow path 180, nanobubbles having a diameter of approximately 120 nm were generated the most, as shown in FIG. 5. The quantity of nanobubbles generated per milliliter could be confirmed as approximately 300 million. On the other hand, when nanobubbles were generated using ozone as the gas with use of the bypass flow path 180, nanobubbles having a diameter of approximately 100 nm were generated the most, as shown in FIG. 6. The quantity of nanobubbles generated per milliliter could be confirmed as approximately just under 400 million.

MODIFIED EXAMPLES

Modified Example 1

In a nanobubble generating nozzle 1 of the present embodiment described with reference to FIG. 1 and FIG. 2, the first flow path 15 is formed in the central portion of the nozzle in the radial direction. In contrast, in the nanobubble generating nozzle 1A of Modified Example 1 illustrated in FIG. 7, the first flow path 15 is formed in an area on the outer side of the nanobubble generating nozzle 1A in the radial direction. An overview of the nanobubble generating nozzle 1A of Modified Example 1 is described with reference to FIG. 7. Note that, in the nanobubble generating nozzle 1A of Modified Example 1 illustrated in FIG. 7, components corresponding to those in the nanobubble generating nozzle 1 illustrated in FIG. 1 and FIG. 2 are described using the same reference signs.

Figure 2:
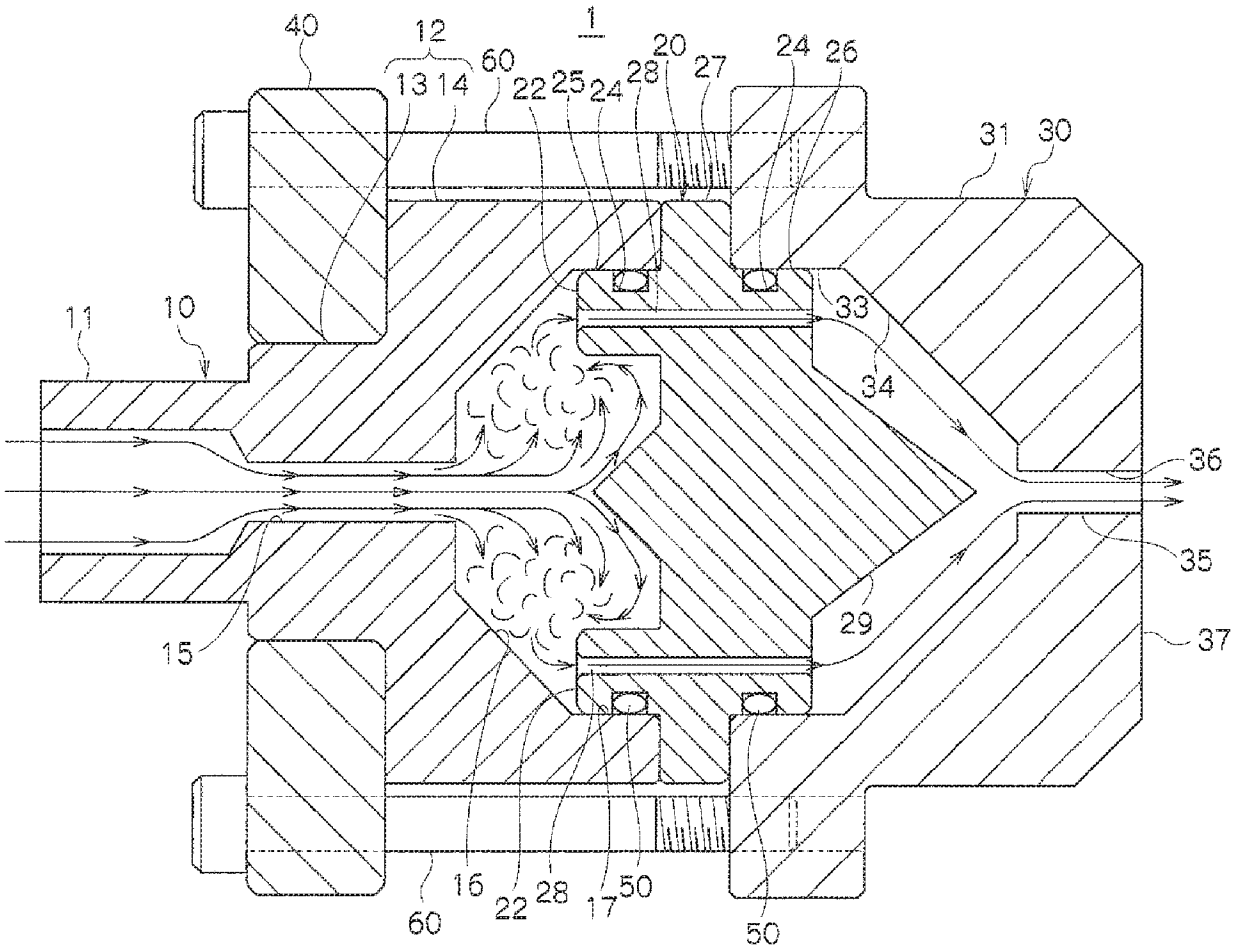
FIG. 2 is an explanatory diagram for explaining the action of the nanobubble generating nozzle illustrated in FIG. 1.

The nanobubble generating nozzle 1A of Modified Example 1, similar to the nanobubble generating nozzle 1 of the present embodiment described with reference to FIG. 1 and FIG. 2, is configured by combining the introduction part constituent 10, the intermediate part constituent 20, and the jetting part constituent 30. Further, provision of the turbulent flow forming part 70 in the space portion formed by the introduction part constituent 10 and the intermediate part constituent 20 is also the same.

On the other hand, a liquid diffusion part 18 for diffusing introduced mixed fluid from the central part in the radial direction toward the outer side is provided to the introduction part constituent 10, immediately after the introduction part 11. Further, the first flow path 15 is formed on the outer side of the liquid diffusion part 18 in the radial direction. Furthermore, the second flow path 28 formed in the intermediate part constituent 20 is formed on the inner side of the first flow path 15 in the radial direction.

The turbulent flow forming part 70 is configured by providing a protruding part 80 protruding toward the introduction part constituent 10 side, on the end surface on the upstream side of the intermediate part constituent 20. The protruding part 80 is formed at the position between the first flow path 15 and the second flow paths 28 in the radial direction.

This turbulent flow forming part 70 causes the liquid that flows out from the first flow path 15 to temporarily collide with the end surface of the intermediate part constituent 20. The liquid that is caused to collide with the end surface temporarily returns by the upstream side by the protruding part 80 while directed from the outer side to the inner side in the radial direction. Through this process, the flow of the liquid becomes a turbulent flow.

Figure 7:
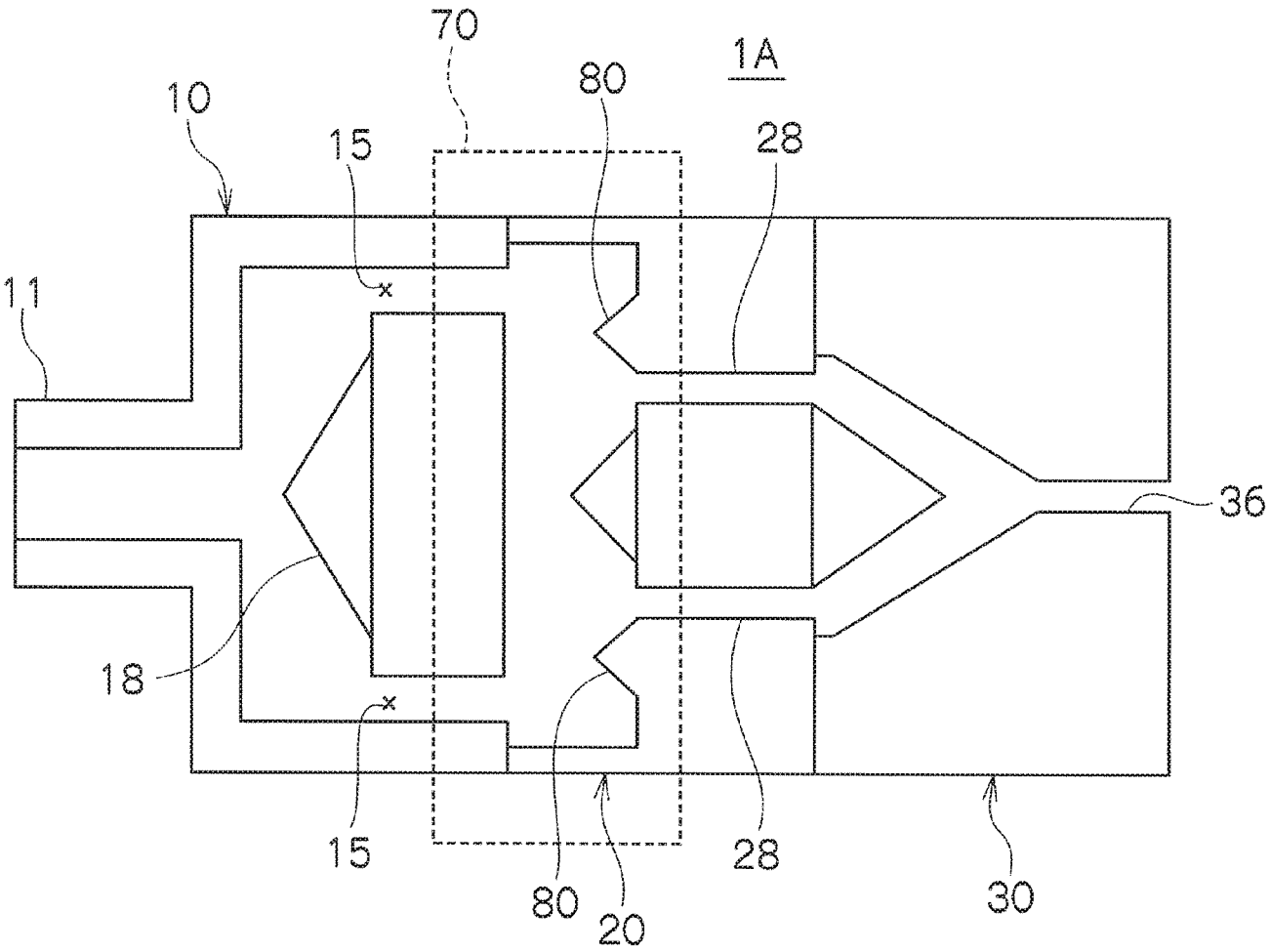
FIG. 7 is an outline diagram illustrating a modified example of the nanobubble generating nozzle of the present invention by modeling.

Note that, in the nanobubble generating nozzle 1A illustrated in FIG. 7, the configuration and the action on the downstream side of the second flow paths 28 are the same as those of the nanobubble generating nozzle 1 illustrated in FIG. 1 and FIG. 2, and thus descriptions thereof are omitted here.

Modified Example 2

Figure 8:
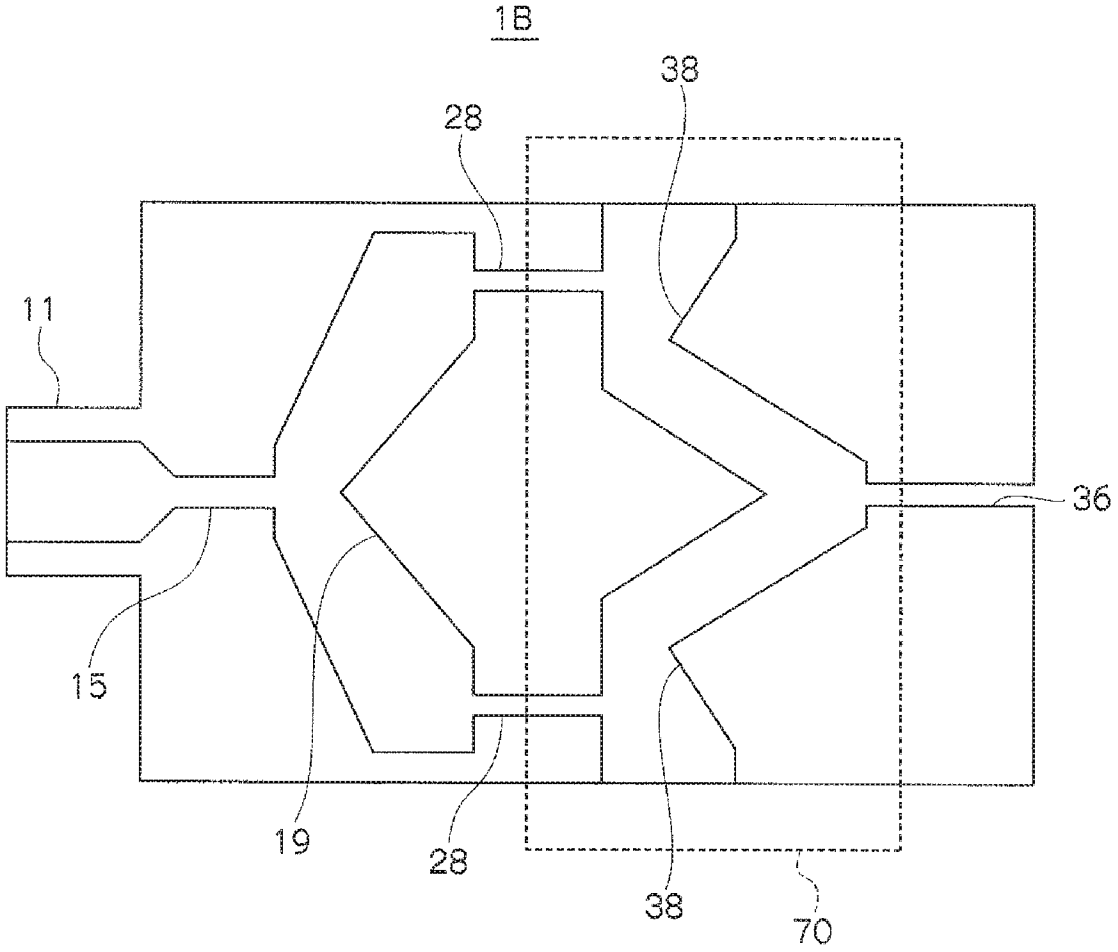
FIG. 8 is an outline diagram illustrating another modified example of the nanobubble generating nozzle of the present invention by modeling.

FIG. 8 illustrates an outline of a nanobubble generating nozzle 1B of Modified Example 2. The nanobubble generating nozzle 1B of Modified Example 2 is an embodiment in which the turbulent flow forming part 70 is provided between the second flow paths 28 and the third flow path 36.

In this nanobubble generating nozzle 1B, a protruding part 19 in which a tip end thereof protrudes toward the first flow path 15 is provided immediately after the first flow path 15. This protruding part 19 diffuses the mixed fluid that flows out from the first flow path 15 from the center to the outer side in the radial direction. The second flow path 28 is formed at a position on the outer side of the base of the protruding part 19 in the radial direction. Thus, the mixed fluid diffused by protruding part 19 directly flows into the second flow paths 28.

The third flow path 36 is formed in the center in the radial direction, on the most downstream side of the nanobubble generating nozzle 1B. The turbulent flow forming part 70 is provided between the third flow path 36 and the second flow paths 28 formed on the upstream side of the third flow path 36.

The turbulent flow forming part 70 is configured by providing a protruding part for temporarily directing the flow of the mixed fluid that flows out from the second flow path 28 to the upstream side. Specifically, a protruding part 38 protruding from the downstream side toward the upstream side is provided between the second flow paths 28 and the third flow path 36 in the radial direction. This protruding part 38 temporarily directs the flow of the mixed fluid that flows out from the second flow paths 28 to the upstream side until the mixed fluid flows into the third flow path 36. The turbulent flow forming part 70 forms a turbulent flow by changing the direction of the flow of the mixed fluid.

According to the nanobubble generating nozzle described above, it is possible to make the nanobubble generating nozzle compact and generate nanobubbles with high efficiency. Further, according to the nanobubble generator that uses this nanobubble generating nozzle as well, it is possible to generate nanobubbles with high efficiency. Thus, the nanobubble generating nozzle and the nanobubble generator can be used in various industrial fields.

For example, the nanobubble generating nozzle and the nanobubble generator can be used in industrial fields such as the food and beverage field, pharmaceutical field, medical field, cosmetics field, plant culture field, solar cell field, secondary battery field, semiconductor device field, electronic equipment field, washing device field, and functional material field. Specific examples in the washing device field include fiber washing, metal mold washing, machine part washing, and silicon wafer washing.

DESCRIPTIONS OF REFERENCE NUMERALS

1 Nanobubble generating nozzle
5 Nanobubble generating structure part
10 Introduction part constituent
11 Introduction part
11*a* Introduction passage
12 Main body part
13 Small diameter area
14 Large diameter area
15 First flow path
16 Tapered portion
17 Straight portion
18, 19 Protruding part
20 Intermediate part constituent
21 First protruding part
22 Ring-shaped protruding part
23 End surface
24 Seal groove
25 Upstream side outer circumferential surface area
26 Downstream side outer circumferential surface area
27 Flange portion
28 Second flow path
29 Second protruding part
30 Jetting part constituent
31 Main body part
32 Flange part
33 Straight portion
34 Tapered portion
35 Jetting part
36 Third flow path
37 End surface
38 Protruding part
40, 45 Holder
50 O-ring
60 Bolt
61 Nut
70 Turbulent flow forming part
80 Protruding part
100 Nanobubble generator
120 Gas introducing part
125 Hose or pipe
126 Switch valve
130 Pump
131 Driving source (Motor)
140 Hose or pipe
141 Main flow path
145 Valve
150 Liquid storage tank
160 Return path
170 Circulating part
180 Bypass flow path

What is claimed is:

1. A nanobubble generating nozzle comprising:

an introduction part for introducing a mixed fluid of a liquid and a gas into an interior thereof;

a jetting part for feeding out the mixed fluid containing nanobubbles of the gas; and a nanobubble generating structure part for generating nanobubbles of the gas, between the introduction part and the jetting part, wherein:

the nanobubble generating structure part comprises an upstream part having a first flow path, an intermediate part having a second flow path, and a downstream part having a third flow path so that the mixed fluid flows from the introduction part to the jetting part through the first to third flow paths arranged in that order;

two of the first to third flow paths adjacent to each other are arranged at different positions of the nanobubble generating nozzle in a radial direction perpendicular to a direction of flowing the mixed fluid flows from the introduction part to the jetting part;

the intermediate part of the nanobubble generating nozzle has a first turbulent flow forming part for making the flow of the mixed fluid into a turbulent flow, and an inlet for introducing the mixed fluid from the first flow path into the second flow path, the inlet being disposed adjacent to the first turbulent flow forming part; and the first turbulent flow forming part has a conical shape that tapers toward an outlet of the first flow path.

2. The nanobubble generating nozzle according to claim 1, wherein:

the first flow path is disposed at a center of the upstream part in the radial direction, the second flow path is disposed on an outer side of the center of the intermediate part in the radial direction, and the third flow path is disposed at the center of the downstream part in the radial direction.

3. The nanobubble generating nozzle according to claim 1, further comprising a second turbulent flow forming part, disposed between the intermediate part and the downstream part, for making the flow of the mixed fluid into a turbulent flow.

4. The nanobubble generating nozzle according to claim 1, wherein:

the first turbulent flow forming part diffuses the mixed fluid that flows out from the first flow path toward the outer side of the intermediate part in the radial direction; and the inlet of the second flow path is disposed at a position that allows the diffused mixed fluid to partially return to a side of the first flow path.

5. A nanobubble generator comprising:

a circulating part for allowing a liquid to flow therethrough;

a gas introducing part for introducing a gas into the circulating part;

a pump for feeding out a mixed fluid of the gas and the liquid that flows through an interior of the circulating part;

a nanobubble generating nozzle for introducing the mixed fluid fed out by the pump and obtaining a mixed fluid containing the nanobubbles of the gas;

a liquid storage tank for storing the mixed fluid containing the nanobubbles; and a return path for returning the mixed fluid containing the nanobubbles stored in the liquid storage tank to the circulating part, wherein:

the nanobubble generating nozzles comprises an introduction part for introducing the mixed fluid into an interior thereof, a jetting part for feeding out the mixed fluid containing nanobubbles of the gas, and a nanobubble generating structure part for generating nanobubbles of the gas, between the introduction part and the jetting part;

the nanobubble generating structure part comprises an upstream part having a first flow path, an intermediate part having a second flow path, and a downstream part having a third flow path so that the mixed fluid flows from the introduction part to the jetting part through the first to third flow paths arranged in that order;

two of the first to third flow paths adjacent to each other are arranged at different positions of the nanobubble generating nozzle in a radial direction perpendicular to a direction of flowing the mixed fluid flows from the introduction part to the jetting part;

the intermediate part of the nanobubble generating nozzle has a first turbulent flow forming part for making the flow of the mixed fluid into a turbulent flow, and an inlet for introducing the mixed fluid from the first flow path into the second flow path, the inlet being disposed adjacent to the first turbulent flow forming part; and the first turbulent flow forming part has a conical shape that tapers toward an outlet of the first flow path.

6. The nanobubble generator according to claim 5, further comprising a second turbulent flow forming part, disposed between the intermediate part and the downstream part, for making the flow of the mixed fluid into a turbulent flow.

7. A nanobubble generator comprising:

a circulating part for allowing a liquid to flow therethrough;

a gas introducing part for introducing a gas into the circulating part;

a pump for feeding out a mixed fluid of the gas and the liquid that flows through an interior of the circulating part;

a nanobubble generating nozzle for introducing the mixed fluid fed out by the pump and obtaining a mixed fluid containing the nanobubbles of the gas;

a liquid storage tank for storing the mixed fluid containing the nanobubbles;

a return path for returning the mixed fluid containing the nanobubbles stored in the liquid storage tank to the circulating part;

a valve for branching a flow path connecting the pump and the liquid storage tank; and a bypass flow path for directly communicating the valve and the liquid storage tank, between the pump and the liquid storage tank, wherein:

the nanobubble generating nozzles comprises an introduction part for introducing the mixed fluid into an interior thereof, a jetting part for feeding out the mixed fluid containing nanobubbles of the gas, and a nanobubble generating structure part for generating nanobubbles of the gas, between the introduction part and the jetting part; and the nanobubble generating structure part comprises a plurality of flow paths having different cross-sectional areas in an axial direction of the nanobubble generating nozzle.

8. The nanobubble generator according to claim 7, wherein:

the first flow path is disposed at a center of the upstream part in the radial direction, the second flow path is disposed on an outer side of the center of the intermediate part in the radial direction, and the third flow path is disposed at the center of the downstream part in the radial direction.

* * * * *